United States Patent [19]

Katona

[11] Patent Number: 4,606,324

[45] Date of Patent: Aug. 19, 1986

[54] OVEN DOOR

[75] Inventor: Joseph W. Katona, Walled Lake, Mich.

[73] Assignee: Mills Products, Inc., Farmington, Mich.

[21] Appl. No.: 687,054

[22] Filed: Dec. 28, 1984

[51] Int. Cl.[4] ..... F24C 15/02

[52] U.S. Cl. ..... 126/198; 126/200

[58] Field of Search ..... 126/198, 190, 200; 52/788, 790, 171

[56] References Cited

U.S. PATENT DOCUMENTS

| | | | |
|---|---|---|---|
| 3,362,396 | 1/1968 | Hurko | 126/200 |
| 3,717,138 | 2/1973 | Upp | 126/200 |
| 3,760,792 | 9/1973 | White | 126/200 |
| 3,855,994 | 12/1974 | Evans et al. | 52/788 |
| 3,877,460 | 4/1975 | Lotz et al. | 126/200 |
| 3,893,442 | 7/1975 | Nuss | 126/200 |
| 3,910,254 | 10/1975 | Morgan | 126/198 |
| 4,023,554 | 5/1977 | Katona | 126/198 |
| 4,043,091 | 8/1977 | Katona | 126/200 |
| 4,084,571 | 4/1978 | McFarland | 126/198 |
| 4,163,444 | 8/1979 | Drouin | 126/198 |
| 4,206,338 | 6/1980 | Katona | 126/200 |
| 4,253,286 | 3/1981 | Katona | 52/790 |

*Primary Examiner*—Samuel Scott
*Assistant Examiner*—H. A. Odar
*Attorney, Agent, or Firm*—Barnes, Kisselle, Raisch, Choate, Whittemore & Hulbert.

[57] ABSTRACT

An oven door having an inner panel between the back and front panels. The back and inner panels have aligned window openings. A window unit between the back panel and inner panel has a pair of glass panes aligned with the window openings. A suspended glass pane between the inner panel and front panel is aligned with the window openings. The front panel has a glass pane provided with a viewing area aligned with the window openings, or it may have a window opening aligned with the window openings in the back and inner panels and there may be another suspended glass pane to cover the window opening in the front panel. Fasteners connect the inner panel window unit and suspended glass pane or panes to the back panel.

15 Claims, 10 Drawing Figures

OVEN DOOR

This invention relates generally to oven doors and refers more particularly to an oven door for use with an oven of the self-cleaning type.

SUMMARY OF THE INVENTION

One object of this invention is to provide an improved oven door which can be quickly and easily assembled and requires only a relatively few fasteners to secure the components together.

In the specific embodiment about to be described, the oven door comprises back and front panels, and an inner panel between the back and front panels. The back and inner panels have aligned window openings. There is a window unit between the back panel and the inner panel which has a pair of glass panes aligned with the window openings and mounting brackets on both sides. There is a suspended glass pane between the inner and front panels which is aligned with the window openings and has mounting brackets on both sides. The front panel may have a glass pane provided with a viewing area aligned with the window openings, or it may have a window opening and there may be another suspended glass pane to cover the window opening in the front panel which is also provided with mounting brackets.

An important feature of the invention resides in the fact that only a relatively few fasteners are required to secure the components of the oven door together. Certain fasteners extend through the inner panel and the brackets of the window unit and of the suspended glass pane or panes to connect such components to the back panel. This greatly reduces assembly time and the number of parts involved.

Other objects and features of the invention will become more apparent as the following description proceeds especially when considered with the accompanying drawings.

DETAILED DESCRIPTION

Figures 1, 1A:
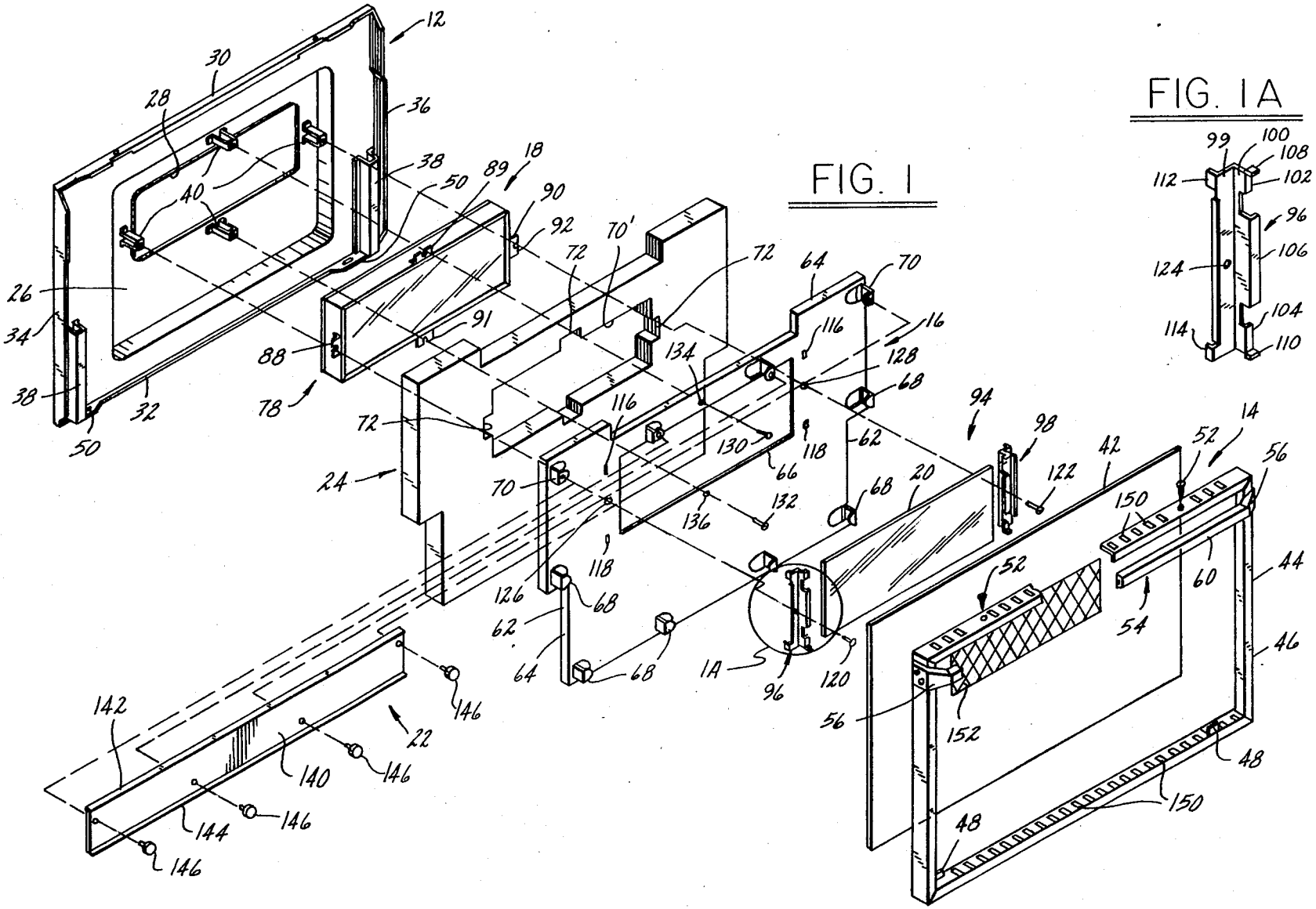
FIG. 1 is an exploded perspective view of an oven door constructed in accordance with my invention.
FIG. 1A is a perspective view of a mounting bracket for one of the glass panes in the door.
Figure 2:
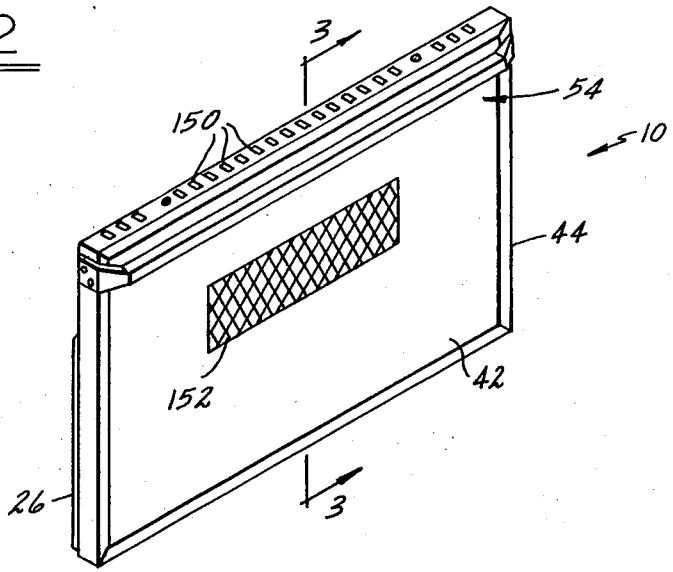
FIG. 2 is a perspective view of the door.
Figure 4:
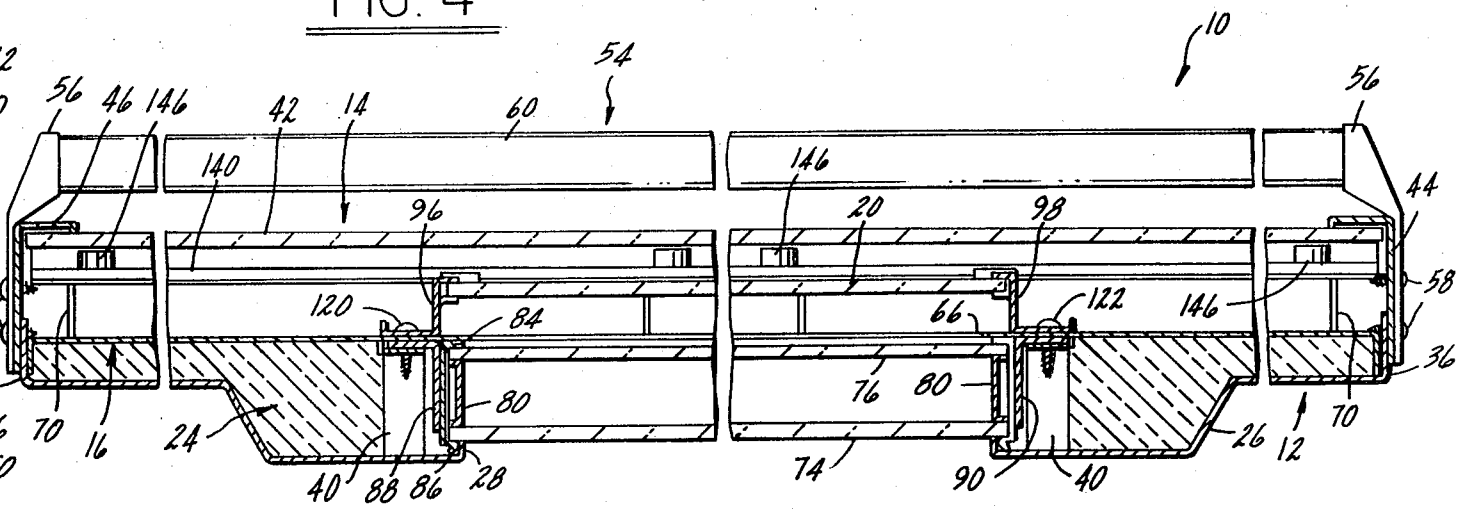
FIG. 4 is a sectional view taken on the line 4—4 in FIG. 3.
Figure 3:
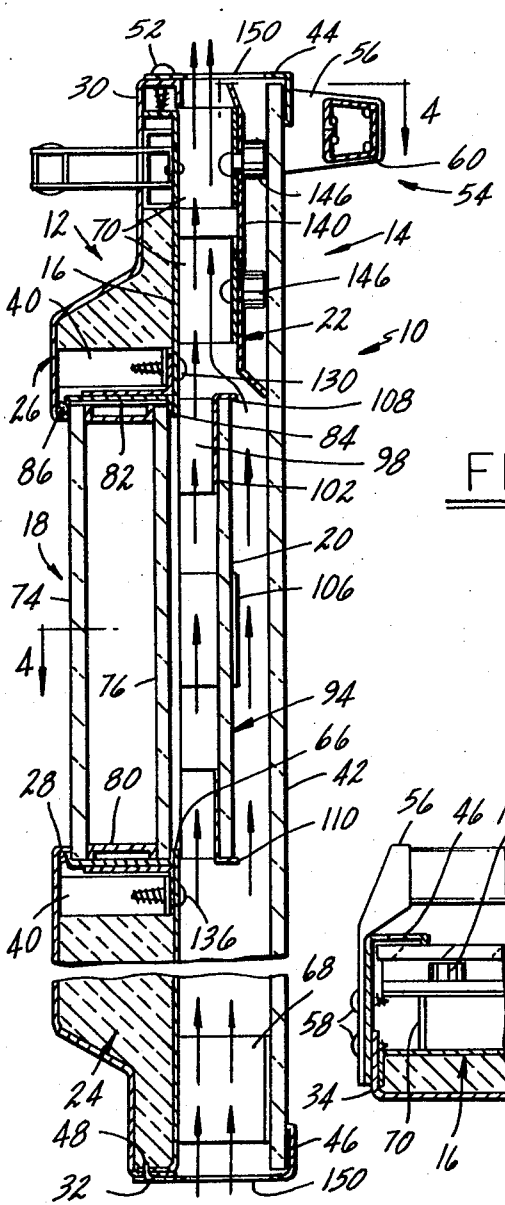
FIG. 3 is a vertical sectional view of the door taken on the line 3—3 in FIG. 2.

Referring now more particularly to the drawings and especially to FIGS. 1 to 4, the oven door 10 comprises a back panel 12, a front panel 14, an inner panel 16, a window unit 18, a suspended glass pane 20, a heat shield 22 and an insulation layer 24.

The back panel is generally rectangular and has a rearwardly bulging central section 26 in the central upper area of which is a rectangular window opening 28. The rear panel has forwardly extending flanges 30 and 32 at the top and bottom edges, and forwardly extending flanges 34 and 36 at the sides. Rectangular channels 38 on the inner surface of the back panel near the side edges thereof are provided to receive bayonet arms of a hinge mount to connect the door to the oven. Mounting brackets 40, one adjacent to the mid-point of each of the four sides of the window opening 28, are secured to and project forwardly from the back panel.

The front panel 14 is spaced from the back panel 12 and extends generally parallel to the back panel. The front panel comprises a rectangular glass pane 42 of about the same size as the rear panel, and a surrounding rectangular border frame 44. The frame 44 along its four sides has an inwardly extending flange 46 at its front edge which engages and supports the front of the glass pane 42. The border frame at the bottom extends rearwardly far enough to overlap the flange 32 at the bottom of the rear panel, and has bent up tabs 48 extending into slots 50 in the flange 32 to connect the two panels together at the bottom. At the top, the border frame 44 extends rearwardly far enough to overlap the top flange 30 of the rear panel. Screw fasteners 52 connect the frame 44 of the front panel to the flange 30 of the rear panel. The front panel has a handle 54 composed of brackets 56 secured by screw fasteners 58 to the sides of the border frame 44 near the top, and a handle bar 60 secured to and extending between the brackets 56.

The inner panel 16 is spaced between the back and front panels 12 and 14. The inner panel 16 is generally parallel to the back and front panels 12 and 14. The inner panel is of generally rectangular form approximating the dimensions of the rear panel, but cut away along the sides where indicated at 62 to clear the channels 38 on the back panel. The inner panel 16 around its entire periphery has a rearwardly extending flange 64 which engages the rear panel to maintain them in spaced relationship. The inner panel has a rectangular window opening 66 aligned with the window opening 28 in the back panel. There are a plurality of forwardly extending long spacers 68 along the periphery of the lower portion of the inner panel 16 which project forwardly into engagement with the rear side of the glass pane 42 to hold it against the flanges 46 of the border frame 44. There are also a plurality of short spacers 70 along the periphery of the upper portion of the inner panel for a purpose which will be more fully described hereinafter.

The layer 24 of insulation is disposed between the back panel 12 and inner panel 16 and is of a configuration generally similar to that of the inner panel. The layer 24 of insulation has a rectangular window opening 70′ aligned with the window openings 28 and 66 in the back panel and inner panel. This window opening 70′ is notched at about the mid-points of each of its four sides where indicated at 72 to clear the mounting brackets 40 on the back panel.

The window unit 18 is disposed in the window opening 70′ of the insulation layer 24 between the back panel 12 and inner panel 16. The window unit 18 is an assembly of parts which comprises a pair of spaced parallel rectangular transparent glass panes 74 and 76 held in spaced apart relation by a rectangular frame 78 comprising an inner member 80 which is of outwardly opening channel form and which may be made from a length of channel stock bent at the four corners and with the ends fastened together in any suitable manner. Panes 74 and 76 are aligned with window openings 28 and 66 in the back panel and inner panel. The glass panes 74 and 76 are held clamped against the channel 80 by a border frame 82 of rectangular form extending around the four sides of the two panes and having an inwardly extending flange 84 at the front extending along the front of pane 76 and an inwardly extending flange 86 at the rear extending along the rear of pane 74. The flange 86 may have a terminal lip and be flexible enough to permit assembly of the panes 74 and 76 and the channel 80 inside the border frame 82. Mounting brackets 88, 89, 90 and 91 on opposite sides and top and bottom of the frame 78 extend into the notches 72 in the layer 24 of insulation and engage the forward ends of the mounting brackets 40 on the back panel. These brackets 88-91 also engage the inner panel 16 and are centrally notched at 92 to clear certain fastener elements to be described hereinafter.

The suspended glass pane 20 is between the inner panel 16 and the front panel 14 and is a rectangular transparent pane which is aligned with the window openings 28 and 66 in the back panel 12 and inner panel 16. The pane 20 is held on one side edge by a mounting bracket 96 and on the other side edge by a mounting bracket 98 which is a mirror image of the mounting bracket 96. The glass pane 20 and brackets 96 and 98 make up a window assembly 94. Each mounting bracket is of L-shaped form having a laterally extending leg 99 and a forwardly extending leg 100. The leg 100 engages the side edge of the glass pane and has laterally inturned flanges 102 and 104 at the top and bottom which engage the back surface of pane 20. Leg 100 also has a laterally inwardly extending flange 106 which engages the front surface of pane 20. Forwardly extending tabs 108 and 110 at the top and bottom of the leg 100 engage the top and bottom edges of the glass pane. The laterally extending leg 99 of each bracket engages the front surface of the inner panel 16 and has locating tabs 112 and 114 at the top and bottom which extend into slots 116 and 118 in the inner panel. Pane 20 is thus securely held by the brackets 96 and 98 and is located in the position shown on the front side of the inner panel 16 by the engagement of bracket tabs 112 and 114 in the inner panel slots 116 and 118. In this position, the glass pane 20 is spaced forwardly of the glass pane 76 of window unit 18, and spaced rearwardly from the glass pane 42.

The window pane 20 and its brackets, the inner panel 16, and window unit 18 are secured to the back panel 12 by screw fasteners 120 and 122. The screw fastener 120 extends through the hole 124 in the bracket 96 on one side of the window pane 20, through the hole 126 in the inner panel 16, through the notch 92 of bracket 88 on one side of the window unit 18 and threads into bracket 40 on the back panel 12. The fastener 122 extends through the hole 124 in bracket 98, through the hole 128 in the inner panel 16, through the notch 92 in bracket 90 of window unit 18 and threads into a bracket 40 of the back panel 12. The brackets 88 and 90 are clamped between the inner panel 16 and the brackets 40 on the back panel 12. Two additional fasteners 130 and 132 are provided which extend through openings 134 and 136 in the inner panel 16 above and below the window opening therein, through the notches in brackets 89 and 91 on the window unit 18 and thread into the brackets 40 of the back panel 12. Brackets 89 and 91 are clamped between inner panel 16 and brackets 40. Thus a minimum number of fastening elements are employed to secure together the window pane 20, the inner panel 16, window unit 18 and back panel 12.

A heat shield 140 is mounted between the inner panel 16 and front panel 14 above the window unit 18 and the suspended glass pane 20. The heat shield 140 is in the form of a laterally extending, vertically disposed plate having a rearwardly inclined flange 142 at the top and a forwardly inclined flange 144 at the bottom. The heat shield 140 is secured to the short spacers 70 on the inner panel 16 in spaced relation between the inner panel and the glass pane 42 by plugs 146 which extend forwardly into contact with the front glass pane 42 to cooperate with the long spacers 68 in pressing the pane 42 against the flange 46 of the border frame 44.

The top and bottom portions of the border frame 46 of the front panel are formed with a plurality of openings 150 to allow air to enter the space within the door between the inner panel 16 and front panel 14 which provide a passage for the upward flow of air through the door in the spaces between the glass panes 42, 76 and 20. The heat shield 140 protects the portion of the glass pane 42 above glass panes 20, 74 and 76 from the heat of the air flowing through the door, which in this upper region of the door has a substantially elevated temperature.

The rear surfaces of the glass panes 76 and 20 are treated with a suitable heat reflective coating. The front glass pane 42 has a rectangular transparent viewing area 152 which may be lined with a crossing grid pattern, if desired. Outside the viewing area, the front glass pane 42 may be coated with a black ceramic paint.

Figures 5, 5A:
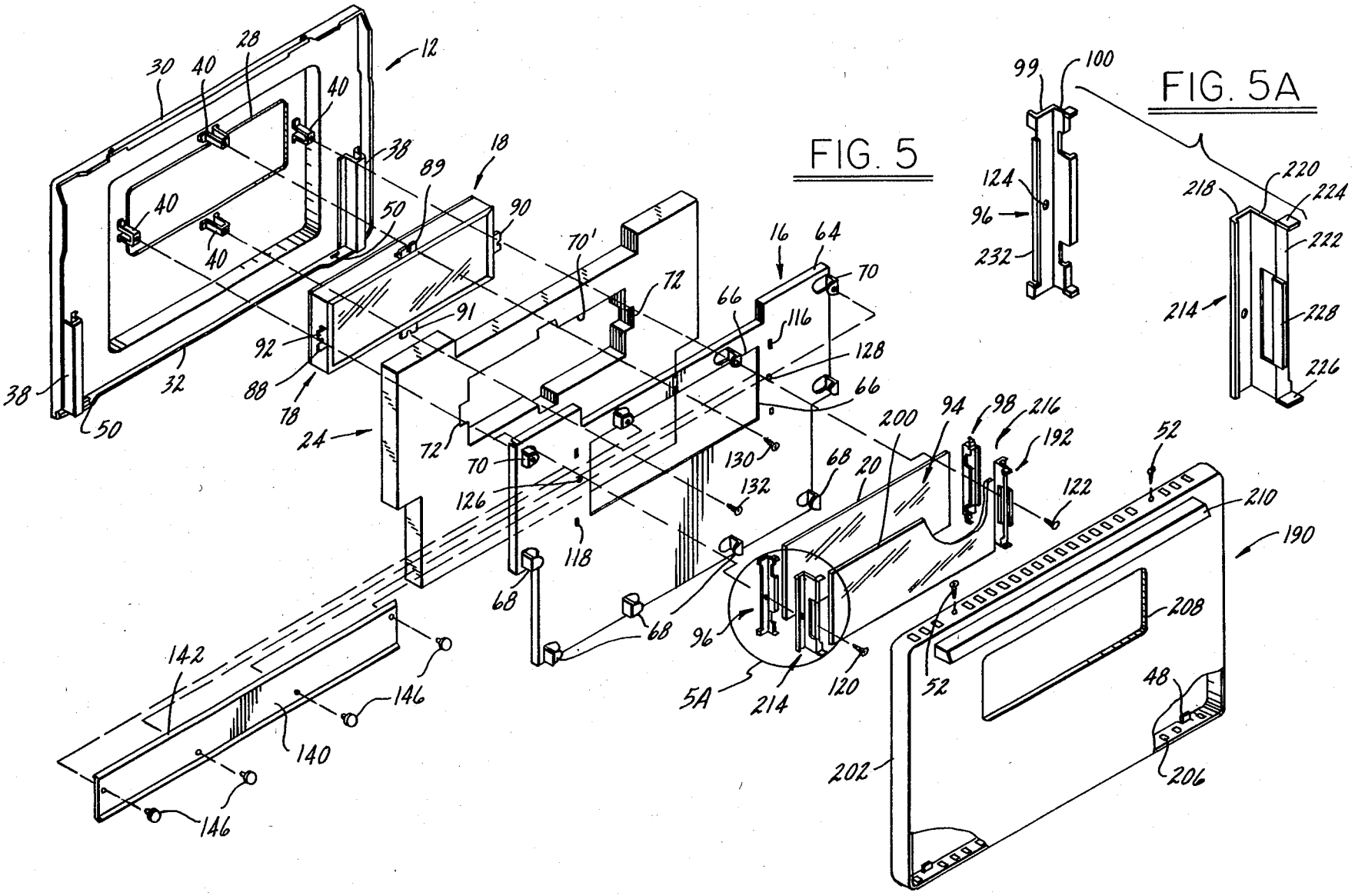
FIG. 5 is an exploded view in perspective showing a door of modified construction.
FIG. 5A is a perspective view of brackets for two glass panes which form parts of the door in FIG. 5.
Figure 6:
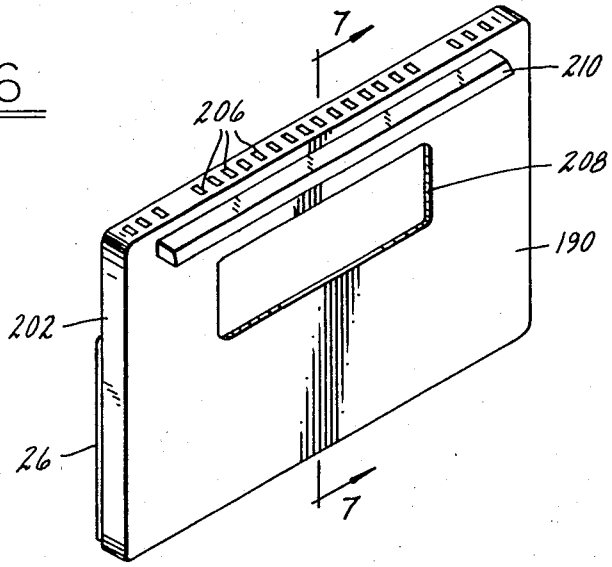
FIG. 6 is a perspective view of the door of FIG. 5.
Figure 8:
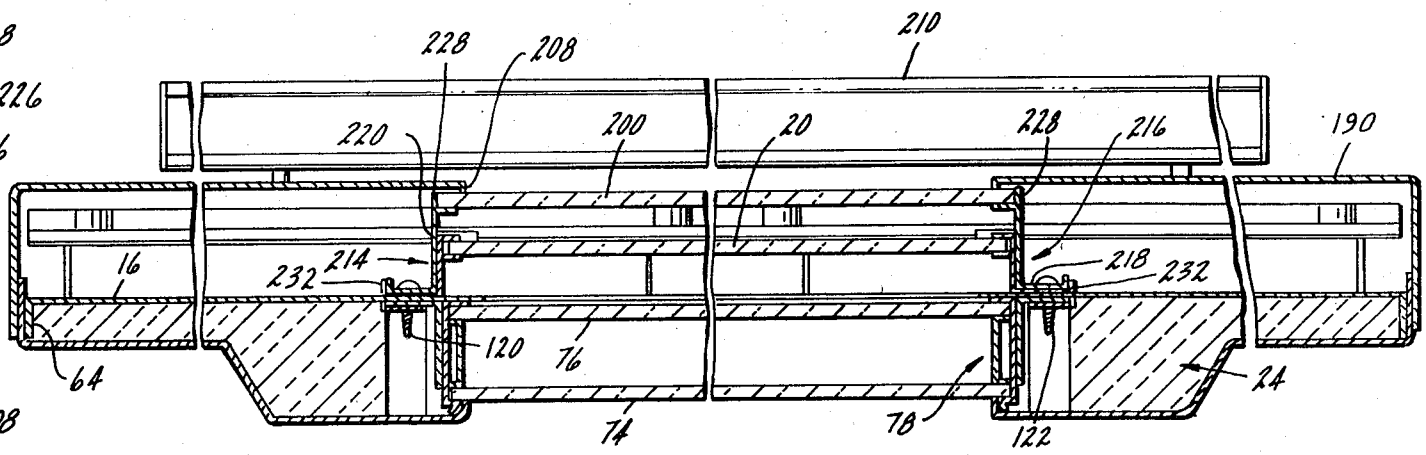
FIG. 8 is a sectional view taken on the line 8—8 in FIG. 7.
Figure 7:
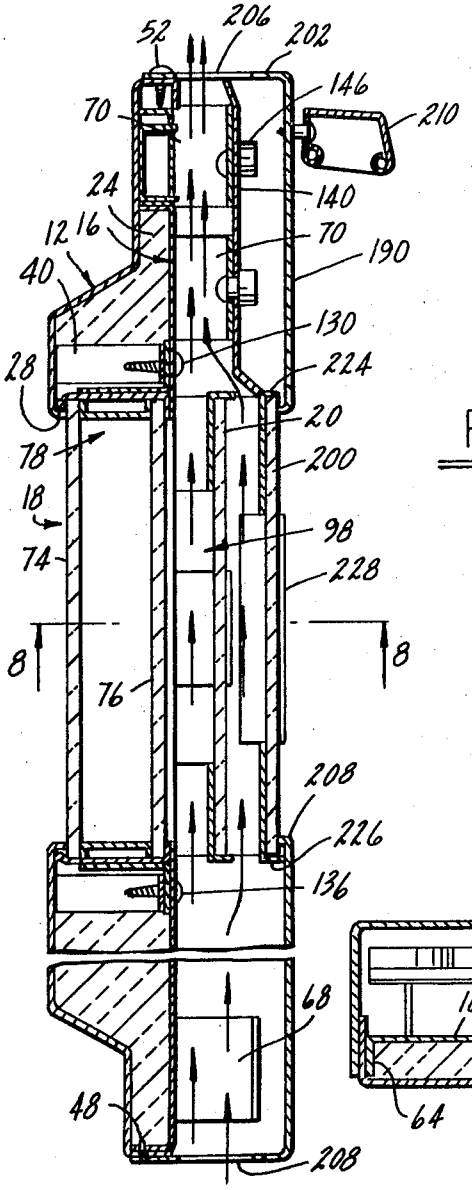
FIG. 7 is a sectional view taken on the line 7—7 in FIG. 6.

FIGS. 5-8 show a modification of the invention which differs from the embodiment of FIGS. 1-4 essentially only in the construction of the front panel 190 and in the addition of another suspended rectangular transparent glass pane 200. The front panel 190 has a forwardly extending peripheral flange 202 which corresponds generally to the border frame 44 of the front panel in the embodiment of FIGS. 1 to 4. The top portion of the flange 202 is secured to the top flange 30 of the back panel 12 by the fasteners 52. The lower portion of flange 202 has upturned tabs 48 which fit into the slots 50 in the bottom flange 32 of the back panel to secure the front and back panels together. The top and bottom portions of the flange 202 have the openings 206, similar to openings 150 in the first embodiment, for the flow of air upwardly through the door. The front panel 190, which may be formed of metal, for example, has a rectangular window opening 208 in the same location as the viewing area in the glass pane of the front panel of the first embodiment. Window opening 208 is aligned with the window openings 28 and 66 in the back and inner panels. A handle 210 is secured to the front panel 190 along the upper edge thereof.

The glass pane 200 is spaced forwardly of the glass pane 20 and is in alignment with the window openings 28, 66 and 208. The glass pane 200 is held on the two sides by mounting brackets 214 and 216 which are mirror images of one another. The glass pane 200 and brackets 214 and 216 make up a window assembly 192. Each mounting bracket is of L-shaped form having a laterally extending leg 218 and a forwardly extending leg 220. Each leg 220 has a laterally inwardly extending flange 222 which engages the rear surface of pane 200. Forwardly extending tabs 224 and 226 at the top and bottom of the flange 222 engage the top and bottom edges of the glass pane. A tab 228 is cut out of the leg 220 and bent in a forward direction so as to engage a side edge of the glass pane. The brackets 214 and 216 have their laterally extending legs 218 seated on the legs 99 of the brackets for the window pane 20. The screw fasteners 120 and 122 which in the first embodiment secure the window pane 20 and its brackets, the inner panel 16 and window unit 18 to the back panel, in this embodiment secure those same components, plus the window glass pane 20 and its brackets to the back panel. It will be noted that the outer edges of the legs 99 of the mounting brackets for the glass pane 20 have forwardly turned flanges 232 forming channels with the forwardly extending legs 100 so as to maintain the brackets 214 and 216 securely seated.

The glass pane 200 is suspended so that its front surface engages the marginal edge of the window opening 208 in the front panel to in effect become a part of the front panel. The glass pane 200 is securely held by brackets 214 and 216 from moving rearwardly, or sidewise, or up or down, and is held by its engagement with the marginal edge of the window opening 208 from moving forwardly. The glass pane 200 thus provides a viewing area into the oven similar to the viewing area in the front panel of the first embodiment.

Although in this embodiment of the invention the spacers 68 and 146 serve no useful purpose, the inner panel, nevertheless, is shown as having these components because the same inner panel may be used in both embodiments of the door.

The other components of the door of FIGS. 5–8 are like those in the door of FIGS. 1–4 and bear like characters of reference.

I claim:

1. An oven door comprising spaced generally parallel back and front panels, an inner panel between and in spaced generally parallel relation to said back panel and front panel, said back panel and inner panel and front panel have aligned window openings therein, a first window assembly between said back panel and inner panel having at least one glass pane aligned with said window openings and having first mounting bracket means, a layer of insulation between said back panel and said inner panel, said insulation layer having a window opening aligned with the window openings in said back, inner and front panels and receiving said first window assembly, a second window assembly between said inner panel and front panel having a second glass pane spaced forwardly of said one glass pane and aligned with said window openings and having second mounting bracket means, a third window assembly between said second window assembly and said front panel having a third glass pane spaced forwardly of said second glass pane and aligned with said window openings and covering the window opening in said front panel, said third window assembly including third bracket means, said first bracket means comprising a bracket on each side of said first window assembly, said second bracket means comprising a bracket on each side of said second window assembly, said third bracket means comprising a bracket on each side of said third window assembly, the brackets of said first, second and third bracket means being aligned respectively with one another, fastening means for securing said first, second and third window assemblies and said inner panel to said back panel, said fastening means including a first fastener connecting said inner panel and the aligned brackets on one side of said first, second and third window assemblies to said back panel, and a second fastener connecting said inner panel and the aligned brackets on the other side of said first, second and third window assemblies to said back panel, said front panel having a peripheral frame which is connected to said back panel, means defining an air passage to allow air to flow upwardly through the door in the spaces between said glass panes, and a heat shield above said window assemblies and between said inner panel and said front panel to cooperate with said inner panel in channeling the upward flow of air therebetween.

2. An oven door as defined in claim 1, wherein said first window assembly has another glass pane aligned with and spaced from said one glass pane which is held to said one glass pane by a peripheral frame.

3. An oven door comprising spaced generally parallel back and front panels, an inner panel between and in spaced generally parallel relation to said back panel and front panel, said back panel and inner panel having aligned window openings therein, a first window assembly between said back panel and inner panel having at least one glass pane aligned with said window openings and having first mounting bracket means, a layer of insulation between said back panel and said inner panel, said insulation layer having a window opening aligned with the window openings in said back panel and inner panel and receiving said first window assembly, a second window assembly between said inner panel and front panel having a second glass pane spaced forwardly of said one glass pane and aligned with said window openings and having second mounting bracket means, said first bracket means comprising a bracket on each side of said first window assembly, said second bracket means comprising a bracket on each side of said second window assembly, the brackets of said first bracket means being aligned respectively with the brackets of said second bracket means, and fastening means for securing said second window assembly, inner panel and first window assembly to said back panel, said fastening means including a first fastener connecting said inner panel and the aligned brackets on one side of said first window assembly and said second window assembly to said back panel, and a second fastener connecting said inner panel and the aligned brackets on the other side of said first window assembly and said second window assembly to said back panel, said front panel comprising a third glass pane spaced forwardly of said second glass pane and having a viewing area aligned with said window openings, said front panel also including a peripheral frame around said third glass pane which is connected to said back panel, means defining an air passage to allow air to flow upwardly through the door in the spaces between said glass panes, and a heat shield above said window assemblies and between said inner panel and said front panel to cooperate with said inner panel in channeling the upward flow of air therebetween.

4. An oven door as defined in claim 3, wherein said first window assembly has another glass pane aligned with and spaced from said one glass pane which is held to said one glass pane by a peripheral frame.

5. An oven door as defined in claim 4, including spacers on said inner panel, and plugs for securing said heat shield to said spacers and also for supporting said front panel.

6. An oven door as defined in claim 5, including additional spacers on said inner panel supporting said front panel.

7. An oven door comprising spaced generally parallel back and front panels, an inner panel between and in spaced generally parallel relation to said back panel and front panel, said back panel and inner panel having aligned window openings therein, a first window assembly between said back panel and inner panel having at least one glass pane aligned with said window openings and having first mounting bracket means, a second window assembly between said inner panel and front panel having a second glass pane spaced forwardly of said one glass pane and aligned with said window openings and having second mounting bracket means, and fastening means for securing said second window assembly, inner panel and first window assembly to said back panel, said fastening means including a fastener element connecting said second bracket means, inner panel and first bracket means to said back panel, said first panel being connected to said back panel and at least a portion of said front panel comprising a third glass pane spaced forwardly of said second glass pane and aligned with said window openings.

8. An oven door as defined in claim 7, wherein said first window assembly has another glass pane aligned with and spaced from said one glass pane which is held to said one glass pane by a peripheral frame.

9. An oven door as defined in claim 7, including a layer of insulation between said back panel and inner panel, said insulation layer having a window opening aligned with the window openings in said back panel and inner panel and receiving said first window assembly.

10. An oven door as defined in claim 7, wherein said first bracket means comprises a bracket on each side of said one glass pane, said second bracket means comprises a bracket on each side of said second glass pane, the brackets of said first bracket means being aligned respectively with the brackets of said second bracket means, said fastener element connecting said inner panel and the aligned brackets on one side of said one glass pane and said second glass pane to said back panel, and a second fastener element connecting said inner panel and the aligned brackets on the other side of said one glass pane and said second glass pane to said back panel.

11. An oven door as defined in claim 7, including spacers on said inner panel supporting said front panel.

12. An oven door as defined in claim 7, having means defining an air passage to allow air to flow upwardly through the door in the spaces between said one, second and third glass panes.

13. An oven door as defined in claim 12, including a heat shield above said window assemblies and between said inner panel and said front panel to cooperate with said inner panel in channeling the upward flow of air therebetween.

14. An oven door as defined in claim 7, including spacers on said inner panel, and plugs for securing said heat shield to said spacers and also for supporting said front panel.

15. An oven door as defined in claim 14, including additional spacers on said inner panel supporting said front panel.

* * * * *